US005083878A

United States Patent [19]

Surti

[11] Patent Number: 5,083,878

[45] Date of Patent: Jan. 28, 1992

[54] RIBBON CARTRIDGE HAVING INTEGRAL GEAR SUPPORTS

[76] Inventor: Tyrone N. Surti, 424 Harding Industrial Dr., Nashville, Tenn. 37211

[21] Appl. No.: 396,559

[22] Filed: Aug. 21, 1989

Related U.S. Application Data

[63] Continuation-in-part of Ser. No. 161,190, Feb. 26, 1988, abandoned.

[51] Int. Cl.[5] ..... B41J 33/26

[52] U.S. Cl. ..... 400/235.1; 400/208

[58] Field of Search ..... 400/194, 195, 196, 196.1, 400/208, 235.1

[56] References Cited

U.S. PATENT DOCUMENTS

| | | | |
|---|---|---|---|
| 4,213,716 | 7/1980 | Carson, Jr. | 400/196.1 |
| 4,232,976 | 11/1980 | Bernardis et al. | 400/195 |
| 4,243,334 | 1/1981 | Shigemori | 400/196.1 |
| 4,279,522 | 7/1981 | Yonkers | 400/195 |
| 4,397,574 | 8/1983 | Wojdyla | 400/235.1 |
| 4,900,170 | 2/1990 | Beck et al. | 400/196 |
| 4,940,345 | 7/1990 | Raar | 400/195 |

FOREIGN PATENT DOCUMENTS

| | | | |
|---|---|---|---|
| 84990 | 7/1981 | Japan | 400/196.1 |
| 199280 | 11/1984 | Japan | 400/208 |
| 8606685 | 11/1986 | World Int. Prop. O. | 400/208 |

*Primary Examiner*—David A. Wiecking
*Attorney, Agent, or Firm*—Phillips & Beumer

[57] ABSTRACT

A ribbon cassette having top and bottom enclosures forming a cavity including a ribbon storage compartment. Ribbon drive means, which includes a pair of spaced elements, is mounted in the cavity for engaging or "pinching" the ribbon therebetween for advancement into the storage compartment. One or both of the elements may be a gear. When only one element is a gear, the other element is a spring assembly. A combined gear support and "stripper" assembly is molded with the upper and lower enclosures and serves as a support for rotatably supporting the gear or gears in the cavity while also preventing the ribbon from winding around or otherwise binding to the gear or gears.

5 Claims, 4 Drawing Sheets

RIBBON CARTRIDGE HAVING INTEGRAL GEAR SUPPORTS

CROSS-REFERENCE OF RELATED APPLICATION

This application is a continuation-in-part of application Ser. No. 07/181,190, filed Feb. 26, 1988, now abandoned.

TECHNICAL FIELD

This invention relates generally to printing ribbon cassettes having meshing gears for passing a ribbon therethrough and particularly to structure formed in the cassette casing for preventing the ribbon from winding around or otherwise binding to the meshed gears.

BACKGROUND OF THE INVENTION

Some conventional ribbon cassettes include a driver gear which is driven by the printer drive shaft and an idler gear disposed in spaced adjacent relation so that a ribbon may pass therebetween where it is squeezed (pinched) between the gears and advanced into a storage cavity of the cassette. Normally, such structure requires a spring to bias the gears together for engagement with the ribbon. Additionally, a ribbon removal device or "stripper" is required so that the ribbon will not wind around the driver or the idler gear.

The ribbon removal device (stripper) typically is mounted in the central region of the driver and idler gears and may be comprised of a plurality of fingers extending between superimposed toothed layers which make up the gears. As many as four or five fingers may be required depending on the size of the gears in order to provide the necessary "stripping" action. Additionally, since the fingers are mounted on a separate support and extend inwardly between the toothed layers which extend from a common central post, each finger must have an arcuate cut-out or slot at the ends thereof which fit partially around the central post.

To manufacture such an apparatus, a complicated cam-operated sold base is required, and due to the case and required space for the cams, the cost per square inch to produce the mold is very high. The required cam-loaded mold adds a minimum of 20% to 35% to the injection mold cycle.

Furthermore, the use of strippers, which are made up of a multiplicity of inwardly extending fingers, requires an undue number of parts, each of which adds to the cost of manufacture. Additionally, the time that it takes to assemble the devices into the ribbon casing is excessive.

Accordingly, it is an object of the present invention to provide a simple, inexpensive device for preventing ribbon from winding around or otherwise binding to a gear or gears which are disposed for engaged relation with the ribbon for driving the ribbon in a predetermined path.

It is a further object of the present invention to provide such a device which will both serve to rotatably support the gear in the casing while also serving as a stripper to prevent the ribbon from winding around or otherwise binding to the gear or gears.

It is yet another object of the present invention to provide such a ribbon cassette with a ribbon storage compartment having a storage separator to separate the ribbon in orderly storage from a compartment entrance section of the cassette.

Another object of the present invention is to provide such storage separator with a ribbon separator which coacts with the storage separator to direct the ribbon into the storage compartment for efficient, orderly storage therein.

It is yet another object of the present invention to provide such a device which is simple in structure, inexpensive to manufacture, and requires no time to assemble in the casing since it is made a part of the casing in the molding process.

SUMMARY OF THE INVENTION

A ribbon cassette having top and bottom enclosures forming a cavity including a ribbon storage compartment. Ribbon drive means including a drive gear disposed for rotation by the drive shaft of a printer and an idler are mounted in the cavity in a predetermined, fixed, spaced relation and are disposed for engaging the ribbon on opposite sides thereof for "pinching" the ribbon for advancement thereof into the storage compartment. The elements which comprise the drive means may be a drive gear and an idler gear or a combination of a rotatable drive gear and a spring assembly. A combination gear and "stripper" is molded into the casing to both support the gear or gears in the predetermined spaced relation to effect the "pinching" action and also to provide a drive which prevents the ribbon from winding around or otherwise binding to the gear. The "stripper" is defined by annular members molded to the inside surfaces of the top and bottom enclosures and extend therefrom to circumferentially support the gear or gears.

DESCRIPTION OF THE PREFERRED EMBODIMENT

Figure 1:
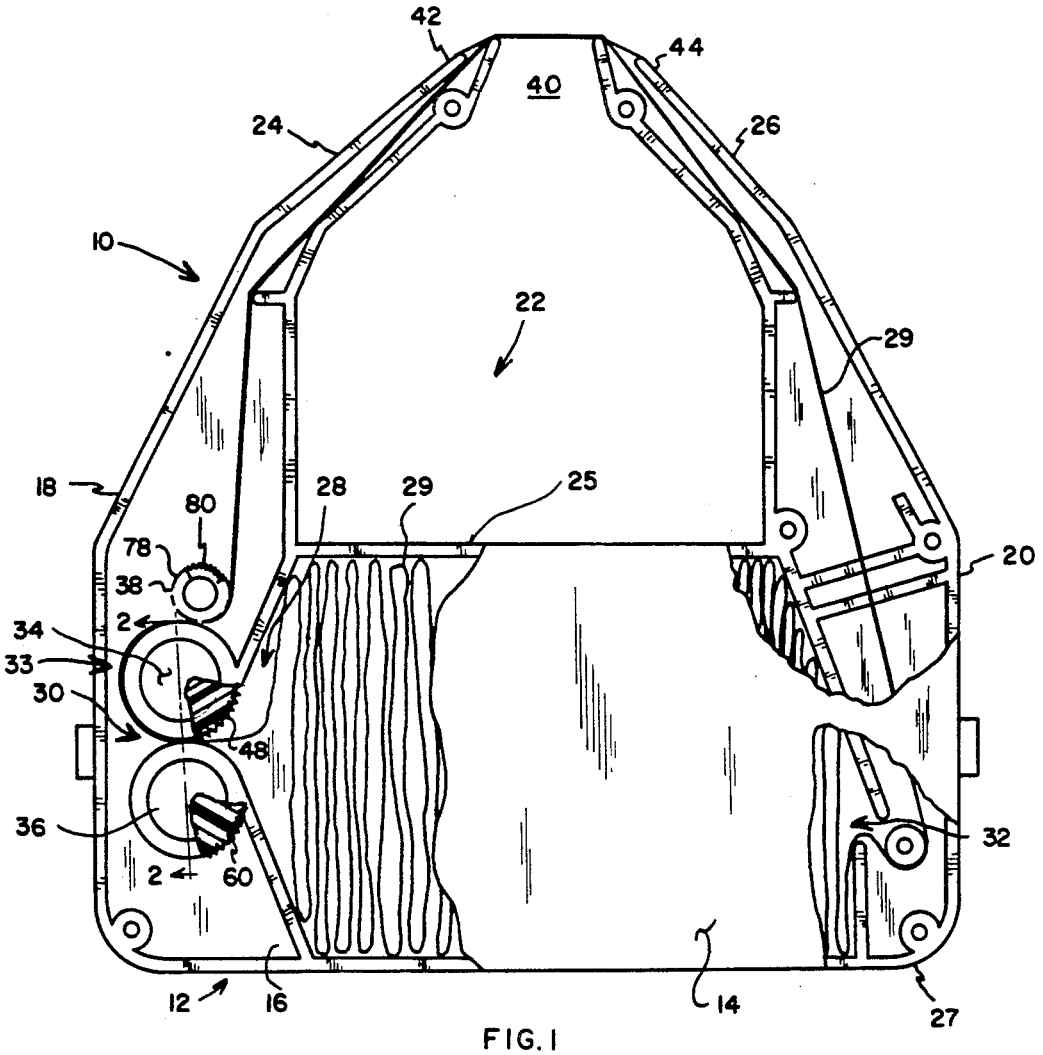
FIG. 1 is a top view of the ribbon cassette of the present invention with the top enclosure partially removed.

As seen in the drawings, a ribbon cassette 10 includes a molded plastic case 12 including a top enclosure 14 (partially removed in FIG. 1), a bottom enclosure 16, a pair of side walls 18 and 20, and forward section 22 including arms 24 and 26 and a rear and front wall 25 and 27. Cover or top enclosure 14 fits over and encloses the walls and bottom enclosure of the cassette case 12, principally enclosing a ribbon storage cavity 28 having a ribbon 29 therein, a ribbon entrance region 30, a ribbon exit region 32, a ribbon drive means 33 including a drive gear 34, and an idler 36. An optional idler gear 38 is also illustrated in FIG. 1. An impact region 40 is provided between the distal ends 42 and 44 of arms 24 and 26. Ribbon 29 includes a pair of edges 31 and 35 (FIG. 1).

Figure 2:
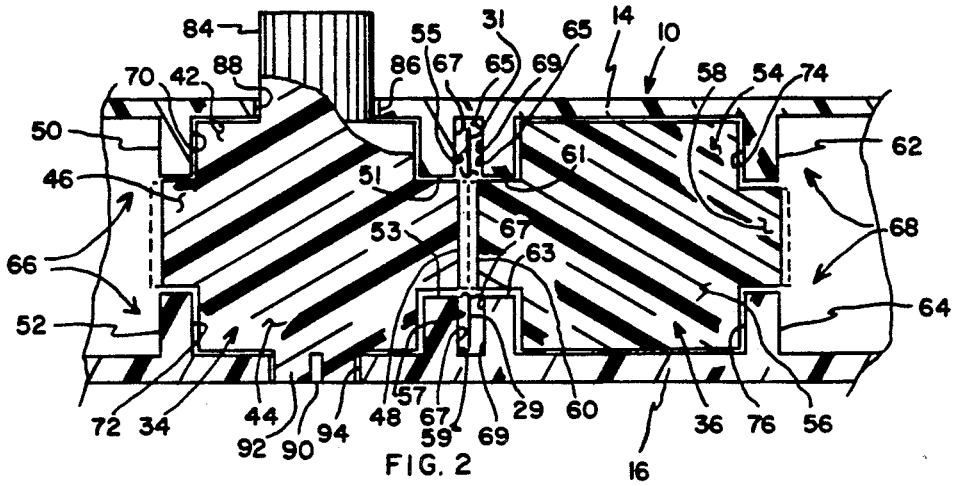
FIG. 2 is a sectional view taken along line 2—2 of FIG. 1.

As seen in FIG. 2, drive gear 34 includes upper and lower annular support sections 42 and 44, respectively, and an intermediate annular section 46 which is of a larger diameter than support sections 42 and 44. A series of teeth 48 is provided around annular intermediate section 46.

To prevent the ribbon from winding around drive gear 34, an annular member 50 is molded with and depends from top enclosure 14 in surrounding relation with section 42, and a second annular member 52 is molded with an extends upwardly from bottom enclosure 16 in surrounding relation with lower annular section 44 of member 34.

Also as seen in FIG. 2, idler 36 includes upper and lower support sections 54 and 56, respectively, and an intermediate annular section 58 which is of a larger diameter than support sections 54 and 56. A series of teeth 60 is provided around annular intermediate section 58.

To prevent the ribbon from winding around idler 36, an annular member 62 is molded to and depends from top enclosure 14 in surrounding relation with section 54, and an annular member 64 is molded to and extends upwardly from bottom enclosure 16 in surrounding relation with lower annular section 56 of member 36.

Also as seen in FIG. 2, the pair of annular members 50 and 52 is provided with distal ends 51 and 53 and end surfaces 55 and 57, respectively, disposed adjacent to distal ends 51 and 53 which form a "stripper" 66 for the drive gear 34. Also, the pair of annular members 62 and 64 is provided with distal ends 61 and 63 and end surfaces 65 and 67, respectively, disposed adjacent to distal ends 61 and 63 which form a "stripper" for idler 36. The annular members or "strippers" 50 and 62 are positioned adjacent one another with a space 65 therebetween through which edge 31 of ribbon 29 passes. The annular members 52 and 64 are positioned adjacent to one another with a space 59 therebetween through which the edge 35 of ribbon 29 passes.

The path of the ribbon takes it from storage cavity 28 through exit region 32, along side 20 where it exits at the distal end 44 of arm 26 and passes through the impact region 40. The ribbon then reenters the cassette casing at distal end 42 of arm 24 and passes along side 18 where it passes over idler 38 and gears 34 and 36 which directs the ribbon into cavity 28. As can be seen in FIG. 2, the strippers 66 and 68 are adjacent one another, and the teeth 48 and 60 of gears 34 and 36 extend slightly beyond the outer periphery 67 and 69 of the strippers to engage ribbon 29 and move ribbon 29 into cavity 28. The strippers effectively remove or "strip" the ribbon from the teeth of gears 34 and 36 and prevents the ribbon from winding around or otherwise binding on the toothed gears. The drive gear 34 is mounted in openings 70 and 72 formed by members 50 and 52, and idler gear 36 is mounted in openings 74 and 76 formed by members 62 and 64. The openings are precisely spaced so that a predetermined constant distance is maintained between the drive and idler gears 34 and 36 so that the ribbon can be engaged by a predetermined force therebetween and pulled into cavity 28 by the drive and idler gears.

Idler 38 is shown in FIG. 1 to include an annular body 78 having teeth 80 around the periphery. It is to be understood that this idler gear may only be used if desired; it is not required.

As seen in FIG. 2, drive gear 34 typically includes a knurled or serrated knob 84 on the upper surface 86 thereof which extends through an opening 88 in top enclosure 14. Drive gear 34 further includes a slotted section 90 on the lower surface 92 thereof which extends into an opening 94 in bottom enclosure 16. Slotted section 90 is disposed to receive the drive shaft of the printer for rotation of drive gear 34.

It can be readily seen that the applicant has provided a ribbon cassette having top and bottom enclosures provided with spaced annular members molded therewith which, in one embodiment, when the top and bottom are assembled to form the cassette body, form supports for the drive and idler gears in predetermined spaced relation while also combining to form "strippers" to prevent the ribbon from winding around or otherwise binding on the ribbon drive and idler gears. In a second embodiment, the applicant has provided the combined support structure and stripper only around the drive gear since, in this embodiment, a passive idler is used. Such a cassette is inexpensive to manufacture and, because of its lack of many complicated parts, may be readily assembled in a facile manner.

Figure 4:
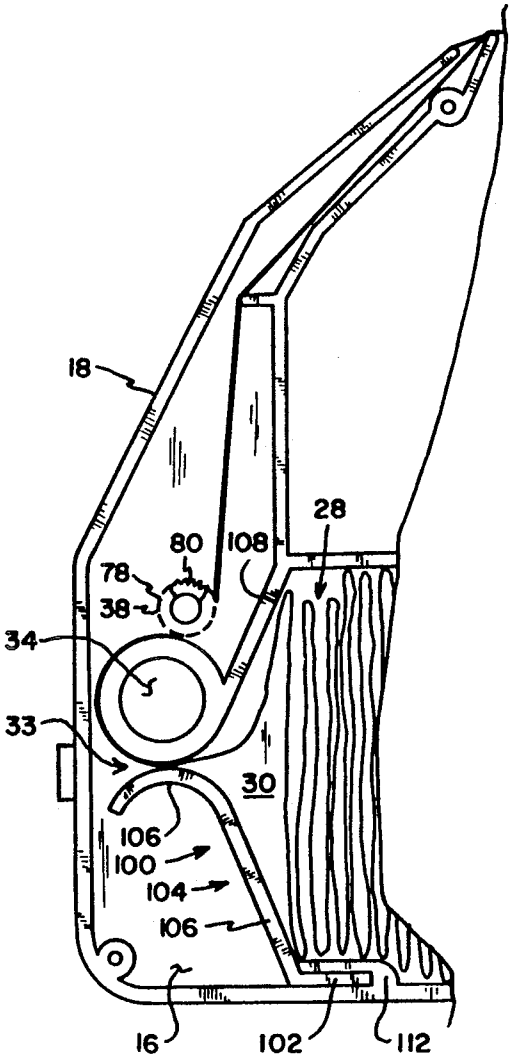
FIGS. 3 and 4 are views similar to FIG. 1 illustrating another embodiment of the present invention.
Figure 3:
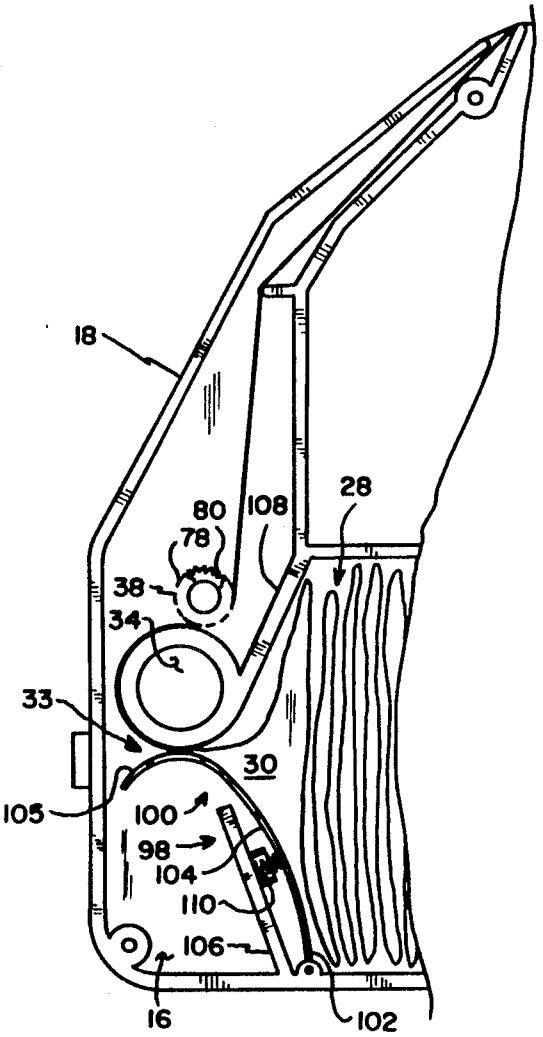

Another embodiment of the present invention includes a different ribbon drive means and is illustrated in FIG. 3 wherein like reference numerals refer to like parts. In this embodiment, the ribbon drive means 33 includes drive gear 34 and, in lieu of idler gear 36, an idler comprised of a spring assembly 98 is disposed for pinching the ribbon against gear 34 to direct the ribbon into storage cavity 28. Assembly 98 includes a resilient elongated member or leaf spring 100 having one end 102 secured to the casing, an intermediate, arcuate portion 104, and an end semi-circular portion 105. Member 100 extends along a support rib 106 which is molded into the lower half of the casing and, along with a second wall 108, form the entrance region 30. A compression spring 100 is secured to rib 106 and is disposed in engagement with spring 100 for biasing the spring against gear assembly 34 to direct the ribbon into storage compartment 28 as discussed above. Alternately, as seen in FIG. 4, the leaf spring 100 may have its end 102 secured in a bracket 112 provided on the casing, its intermediate portion 104 being straight and forming rib 106 which, along with rib 108, acts as an end enclosure for the storage cavity and forms the entrance region 30. It is to be understood that any of many types of arrangements may be resorted to in order to secure end 102 of spring 100 to the casing; it is only necessary that the spring be provided with the capability of exerting a predetermined force by its end 106 against drive gear 34. Of course, end 105 can have other configurations other than the semi-circular configuration shown and described.

Figure 5:
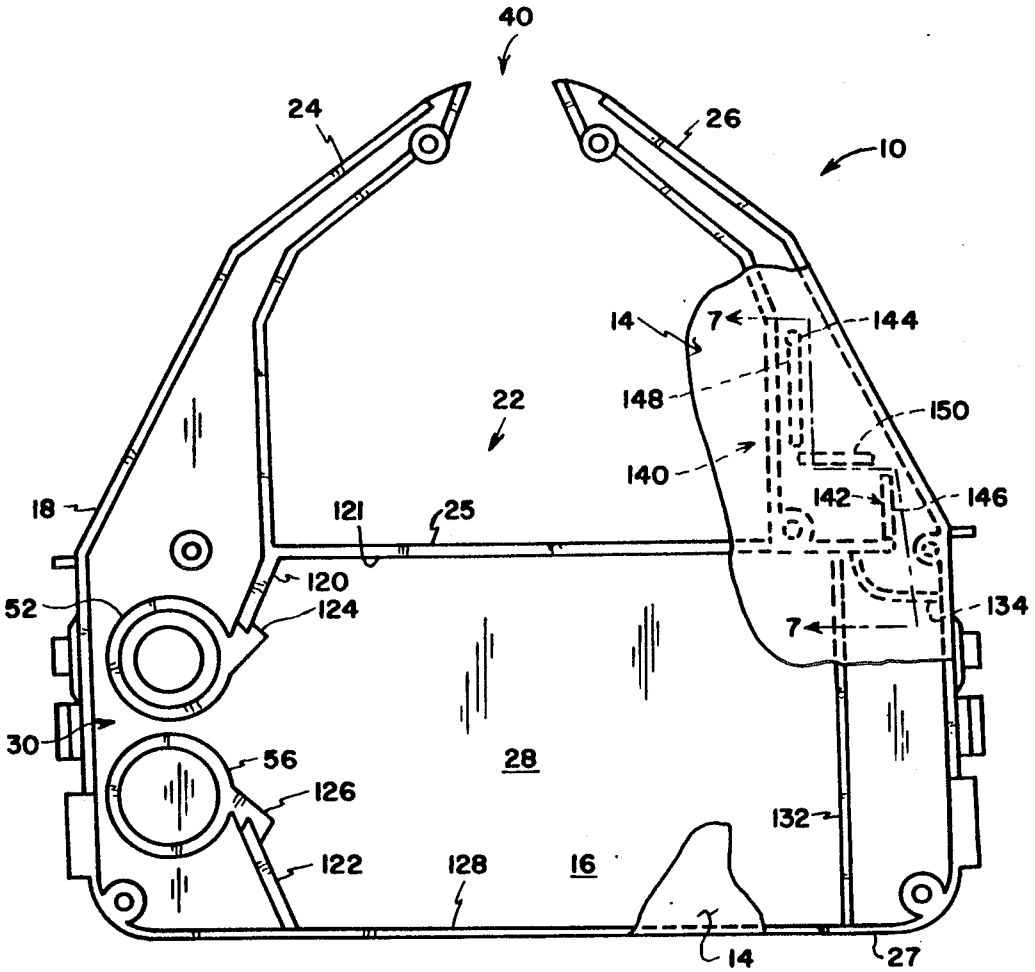
FIG. 5 is a view similar to FIG. 1 illustrating another embodiment of the present invention with the gears removed for clarity and also showing a ribbon guide assembly in phantom lines.
Figure 6:
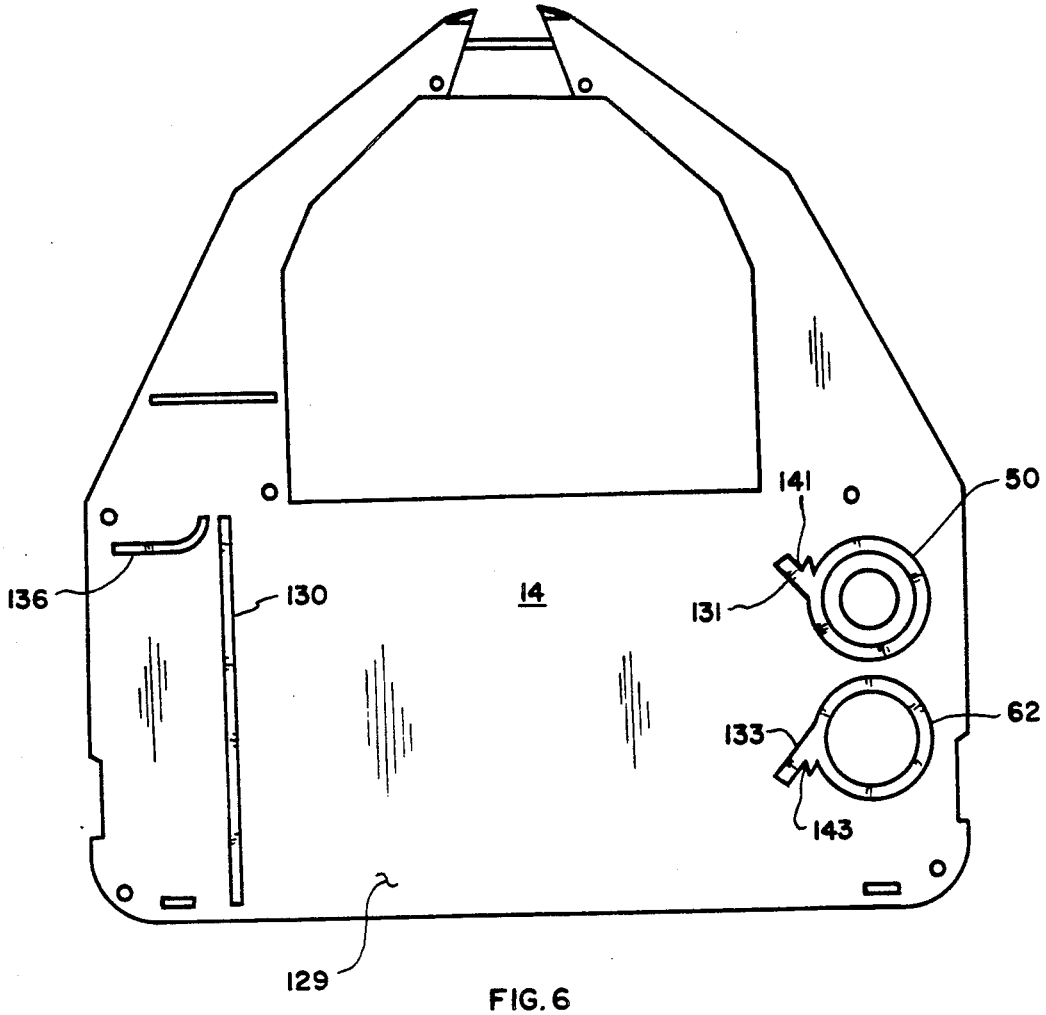
FIG. 6 is an underside plan view of the upper enclosure member of FIG. 5.
Figure 7:
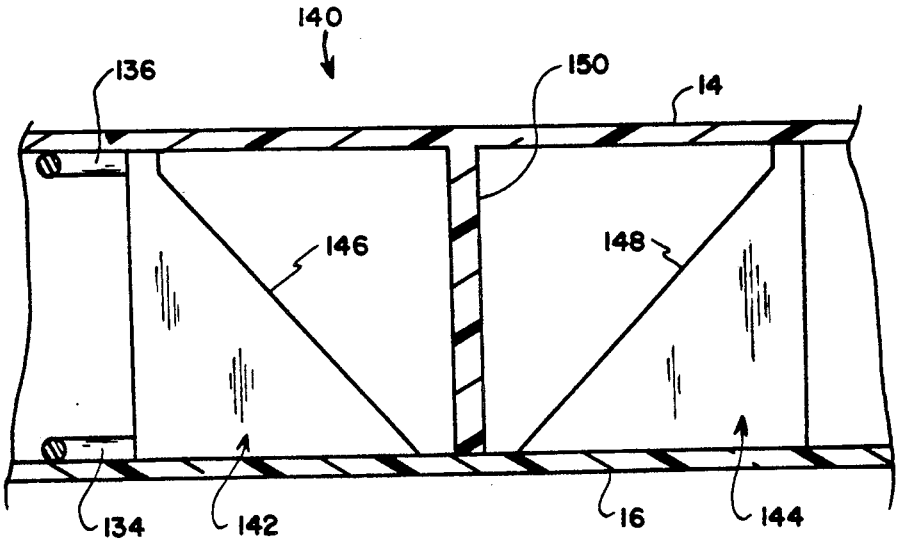
FIG. 7 is an enlarged sectional view taken along line 7—7 of FIG. 5.

FIGS. 5-7 illustrate still another embodiment of the present invention in which the cassette 10 is provided with a pair of storage compartment walls 120 and 122 which separate the ribbon storage compartment 28 from the entrance region 30. As seen in FIG. 5, walls 120 and 122 are molded to the bottom enclosure 16 and extend upwardly to engage the inner surface of the upper enclosure 14. Wall 120 extends inwardly from an inner surface 121 of transverse wall 25 which is also disposed for engagement with the inner surface of the upper enclosure 14. Wall 120 terminates at a ribbon separator 124 which extends in angular relation from lower annular gear support 52. Wall 122 extends from a similar ribbon separator 126 which extends in angular relation from annular idler gear support 56. As can be seen in FIG. 5, wall 122 extends from the lower interior edge 128 of wall 27 of casing 10.

FIG. 6 is a view of the underside 129 of the top enclosure 14 and illustrates a similar construction of the ribbon separators. As can be seen in FIG. 6, ribbon separators 131 and 133 extend from gear supports 50 and 62 in a similar manner as described in relation to the lower ribbon separators 126 and 124. However, these separators are provided with recesses 141 and 143 to receive the upper surfaces of walls 120 and 122 which extend from enclosure 16 upwardly into the recesses.

To provide a means to eliminate the need for tension devices on the ribbon in its path from exit region 22 to entrance region 30, both upper and lower enclosures 14 and 16 are provided with a wall formed by a raised ridge 130 on the lower surface of upper enclosure 14 and a second raised ridge 132 formed on the upper surface of lower enclosure 16. A space is provided between the ridges as they extend only slightly downwardly and upwardly, respectively, from the upper and lower enclosures 14 and 16. Curved ridges 134 and 136 similarly extend, respectively, upwardly from the upper surface of lower enclosure 16 and downwardly from the lower surface of upper enclosure 14. A space is similarly provided between these two curved ridges.

As can be seen in FIGS. 6 and 7, guide means are provided to rotate the ribbon 180° in its path to the impact region. FIG. 7 is a plan view of the bottom enclosure and illustrative the guide mechanism 140 as having a pair of members 142 and 144 extending upwardly from the lower compartment wall 16. The members are provided with 45° sloped surfaces 146 and 148 which extend inwardly to a member 150 which is disposed in normal relation to surfaces 146 and 148. Member 150 is molded to the inner surface of upper enclosure 14 and extends downwardly for mating relation with the upper surface of the lower enclosure 16.

I claim:

1. A ribbon cassette for operation by a drive shaft of a printer comprising:

a casing having top and bottom enclosure and an impact region, said casing having a pair of spaced side walls, and a rear and front wall forming an enclosed compartment;

a ribbon carried in substantially folded relation to said compartment, said ribbon provided with first and second sides and first and second edges;

a drive gear mounted in said compartment for driven relation by the drive shaft of said printer, said drive gear disposed for engagement with said first side of said ribbon, said drive gear comprised of a pair of spaced annular end portions and an intermediate joining annular portion, the diameter of said intermediate portion being larger than the diameters of said end portions;

an idler disposed in said compartment for engagement with said second side of said ribbon;

drive gear support means mounted in said compartment for rotatably supporting said drive gear therein, said drive gear support means including a first annular member integral with and depending from said top enclosure and extending into said compartment and a second annular member integral with said bottom enclosure and extending into said compartment, said first and second annular members of said drive gear support means having distal end surfaces, the distal end, surfaces having a space therebetween; and said drive gear being loosely mounted in said drive gear support means with a first of said pair of annular portions of said drive gear disposed in said first annular member of said drive gear support means, and a second of said pair of annular portions of said drive gear being supported in said second annular member of said drive gear support means, said intermediate portion of said drive gear extending outwardly of said pair of annular members of said drive gear support means in said space between said distal end surfaces of said first and second annular members of said drive gear support means, said intermediate portion of said drive gear having a ribbon engaging surface thereon; each of said annular members of said drive gear support means having an outer surface adjacent to said distal end surfaces thereof which coacts with respective said edges of said ribbon to provide a stripping effect to said ribbon for the removal thereof from said drive gear responsive to movement of said ribbon through said idler and said drive gear,

2. Apparatus as set forth in claim 1 wherein said idler is a gear comprised of a pair of spaced annular end portions and an intermediate joining annular portion, the diameter of said intermediate joining annular portion being larger that the diameters of said annular end portions, and idler gear support means mounted in said compartment for rotatably supporting said idler gear therein, said idler gear support means including a first annular member integral with and depending from said top enclosure and extending into said compartment, and a second annular member integral with said bottom enclosure and extending into said compartment, said first and second annular members having distal end surfaces, the distal end surfaces having a space therebetween; and said idler gear loosely mounted in said idler gear support means with a first of said pair of spaced annular end portions of said idler gear disposed in said first annular member of said idler gear support means, and a second of said pair of spaced annular end portions of said idler gear being supported in said second annular member of said idler gear support means, said intermediate portion of said idler gear extending outwardly of said pair of annular members of said drive gear support means in said space between said distal end surfaces of said annular members of said drive gear support means, said intermediate portion of said idler gear having a ribbon engaging surface thereon, each of said annular members having an outer surface adjacent to said distal end surfaces thereof which coacts with respective said edges of said ribbon for the removal thereof from said idler gear responsive to movement of said ribbon through said idler gear and said drive gear.

3. Apparatus as set forth in claim 2 wherein said intermediate portion of said drive and idler gears includes teeth around the periphery thereof.

4. Apparatus as set forth in claim 3 wherein said compartment includes first and second upstanding walls, said first upstanding wall extending inwardly from said front wall, and said second upstanding wall extending inwardly from said rear wall, said first and second upstanding walls having distal ends disposed in spaced relation and defining a ribbon inlet.

5. Apparatus as set forth in claim 4 wherein said compartment further includes third and fourth upstanding walls, said third upstanding wall extending inwardly from said front wall, and said fourth upstanding wall extending inwardly from said rear wall, said third and fourth walls having distal ends disposed in spaced relation and defining a ribbon exit.

* * * * *